United States Patent [19]

Leupold

[11] Patent Number: 4,887,058

[45] Date of Patent: Dec. 12, 1989

[54] PERIODIC PERMANENT MAGNET STRUCTURES

[75] Inventor: Herbert A. Leupold, Eatontown, N.J.

[73] Assignee: The United States of America as represented by the Secretary of the Army, Washington, D.C.

[21] Appl. No.: 375,218

[22] Filed: Jul. 3, 1989

[51] Int. Cl.[4] ..... H01F 7/22

[52] U.S. Cl. ..... 335/216; 335/306; 505/1

[58] Field of Search ..... 335/216, 212, 302, 304, 335/306; 315/5.24, 5.34, 5.35; 505/1

[56] References Cited

U.S. PATENT DOCUMENTS 4,835,137 5/1989 Leupold ..... 335/216 X

*Primary Examiner*—George Harris

*Attorney, Agent, or Firm*—Michael Zelenka; Ann M. Knab

[57] ABSTRACT

Periodic permanent magnet structures comprise a plurality of paired axially aligned sections of hollow spherical flux sources each of which produces a uniform high-field in its central cavity. Each pair of sections is mounted on opposite sides of a respective plate of permeable material. The magnetic field orientations in the central cavities are axially directed and alternate or reverse in direction from section to section. An axial bore hole drilled through the sections and plates provides a continuous channel or path through which a beam of charged particles will travel.

5 Claims, 1 Drawing Sheet

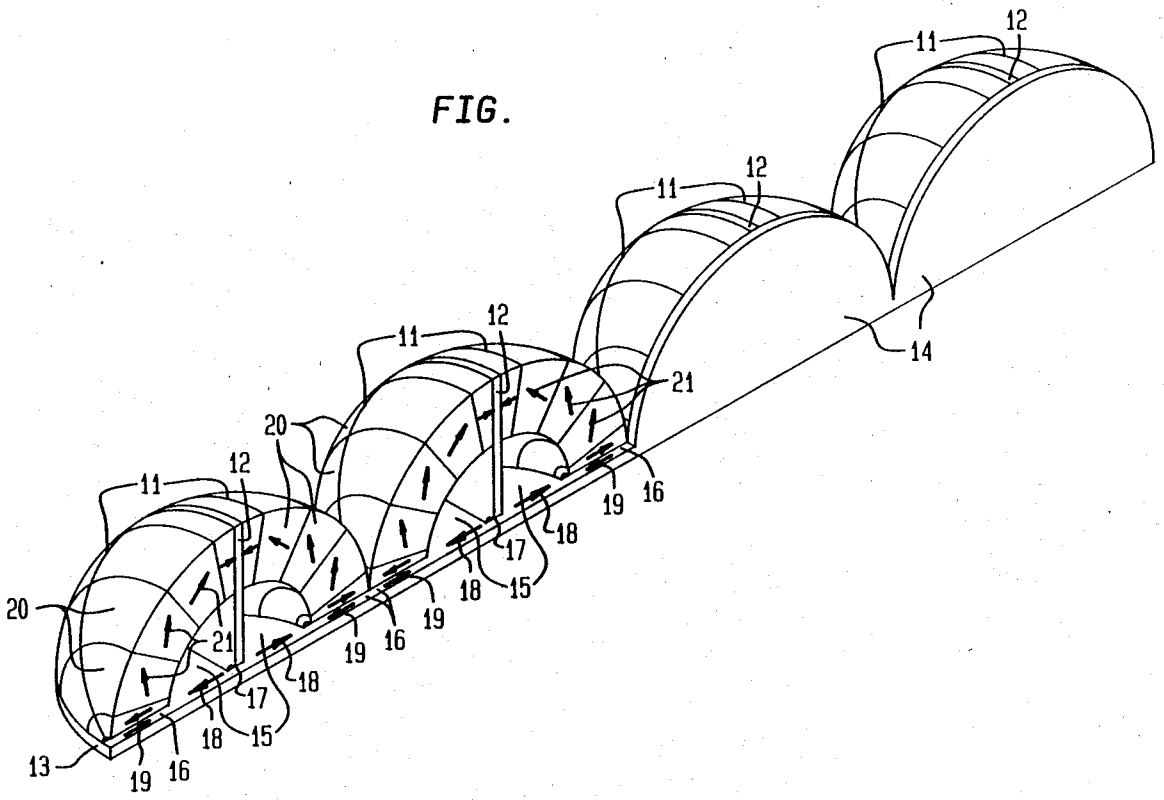
FIG.

PERIODIC PERMANENT MAGNET STRUCTURES

The invention described herein may be manufactured, used, and licensed by or for the Government for governmental purposes without the payment to me of any royalties thereon.

TECHNICAL FIELD

The present invention relates to high-field periodic permanent magnet structures for use in microwave/millimeter wave devices such as traveling wave tubes (TWTs).

BACKGROUND OF THE INVENTION

Both electromagnets and permanent magnets have been used to manipulate beams of charged particles. In traveling wave tubes, for example, magnets have been arranged around the channel through which the beam travels to focus the stream of electrons; that is, to reduce the tendency of the electrons to repel each other and spread out. Various configurations of permanent magnets (and pole pieces) have been tried in an attempt to increase the focusing effect while minimizing the weight and volume of the resulting device. In conventional traveling wave tubes, permanent magnets are typically arranged in a sequence of alternating magnetization, either parallel to, or anti-parallel to, the direction of the electron flow. The magnets (and pole pieces) are usually annular in shape and their axes are aligned with the path of the electron beam. Pole pieces constructed of ferromagnetic material such as electrolytic iron are often placed between the magnets and provide a path through which magnetic flux from the magnets may be directed into the working space along the axis of the traveling wave tube in order to influence the beam in the desired manner. The patent to Clarke, U.S. Pat. No. 4,731,598, issued Mar. 15, 1988, illustrates typical prior art, periodic permanent magnetic (PPM) structures.

One of the critical problems confronting those who develop magnetic structures used to contain or manipulate beams of charged particles has been how to more efficiently utilize the permanent magnet materials which make up the structure(s). Some specific problems include: how to maximize the strength of the magnetic field along the path of the charged particle beam without significantly increasing the mass of the magnetic structure; how to improve performance (e.g., output power); and how to increase the useful life of the TWTs. The present invention addresses these problems, and others.

The above-noted problems were also addressed in the co-pending patent application Ser. No. 213 970, filed July 1, 1988, now U.S. Pat. No. 4,831,351, which is incorporated by reference herein. In this co-pending application there is disclosed a periodic permanent magnet (PPM) structure that comprises a series of hollow spherical flux sources (HSFS) or "magic spheres" placed tangent to each other in pearl string fashion. Axial bore holes through the magnetic poles of the spheres are coaxially aligned to form with spherical central cavities a continuous channel or path through which a beam of charged particles will travel. In any given magic sphere the magnetic field orientation in the axial bore hole is the reverse of that in the central cavity. Thus, the desirable characteristic of alternating magnetization in a PPM stack is fully realized in a string of coaxially aligned magic spheres. This HSFS PPM stack offers focusing fields of about 10 kOe. This is substantially greater than the approximately 6 kOe theretofore obtained in prior art PPM structures.

SUMMARY OF THE INVENTION

The present invention offers focusing fields equal to that of a HSFS stack (10 kOe) and, because it reduces the (magnetic field) period, substantially higher frequency TWT radiation sources can be constructed. Also, the invention results in lower internal operating temperatures in the PPM stack and therefore higher magnetic fields, better beam focusing, more efficient tube operation and longer tube life can be realized.

In accordance with the present invention, paired sections of hollow spherical flux sources (eighth sphere sections) having juxtaposed open ends are placed in a series, tangent to each other, in pearl string fashion. Each pair of sections is mounted on opposite sides of a respective planar sheet of permeable material thereby closing the open ends of the sections, each flux source section producing a uniform high-field in its central cavity. The permeable material is of high saturation and it creates an "anti-mirror" image of the section in its plane magnetically completing the other half of the central cavity. An axial bore hole is drilled through the magnetic pole of each flux source, creating an axial tunnel, and continues through each plate of permeable material wherein a continuous channel is formed through the plurality of axially aligned flux sources. Superconducting sheets abut the flat faces of each flux source magnetically creating a "mirror image" to complete the flux source such that a complete magnetic sphere were its source. The magnetic field orientations in the central cavities and the axial tunnels are in alignment and a continuous channel is formed through which a beam of charged particles may travel.

BRIEF DESCRIPTION OF THE DRAWINGS

The invention will be more fully appreciated from the following detailed description when the same is considered in connection with the accompanying drawing in which:

FIG. 1 illustrates an abbreviated series of eighth sphere sections of hollow spherical flux sources forming a PPM structure in accordance with the present invention.

DETAILED DESCRIPTION

FIG. 1 shows a series of paired eighth sphere sections of hollow spherical flux sources 11 having juxtaposed open ends and arranged linearly with adjacent paired segments 11 in tangential edge contact. The pairs of eighth sphere sections are placed on opposite sides of a planar sheet 12, which is composed of high saturation, high permeability material. Superconducting planar sheets 13 and 14 abut the flat faces of each flux source. Each eighth sphere section has a central cavity 15 and an axial bore hole is drilled through the magnetic pole of each eighth sphere section and through each permeable planar sheet 12 to create respectively, an axial tunnel 16 and bore hole 17.

Each eighth sphere section has a dimension equal to the radius of a full spherical hollow flux source. The large arrows 18 and 19 designate the direction of the magnetic fields in the central cavities and the axial tunnels, respectively. The flux sources are arranged linearly, axially aligned, with adjacent flux sources in tangential edge contact so that the magnetic fields are in alignment, forming a continuous channel or path through which a beam of charged particles may travel.

The eighth sphere section is a hollow flux source that provides a uniform high-field in its central cavity. The hollow eighth sphere section is comprised of magnetic material and its magnetization is azimuthally symmetrical. The magnetic orientation ($\alpha$) in the eighth sphere permanent magnet shell is related to the polar angle $\theta$ by the equation $\alpha=20$. The value is the magnetization angle with respect to the polar axis.

The eighth sphere sections are composed of segments, 20 whereby each segment represents a different magnetic orientation. The small arrows 21 indicate the magnetization orientation at the various segments.

The permeable planar sheets 12 create a magnetic "anti-mirror" image of each eighth sphere section making the eighth sphere central cavity appear (magnetically) as if a quarter sphere section were its source. With the aid of the superconducting planar sheets 13 and 14 a mirror image of the quarter sphere section is magnetically created. Therefore, the magnetic field supplied by a complete spherical flux structure may be obtained, but with one eighth the magnetic structure, through the utilization of a high permeable planar sheet and superconducting planar sheets.

These permeable planar sheets 12 may be comprised of iron, permandur, permalloy, etc. As is known to those skilled in the art, the planar sheet must be thick enough to prevent saturation of the planar sheet material. Stated somewhat differently, the flux in the cavity must not exceed an amount that will result in a value of B (flux density) in the anti-mirror material that is greater than its saturation value. Thus, there is an interrelationship between the desired cavity field and the plate thickness.

Superconducting sheets 13 and 14 cover the flat faces of the flux sources and are figuratively shown as being peripherally coextensive with the flux sources. These sheets can extend beyond the flux sources, in one or more directions, although it is only necessary they be not less in extent than the sources 11. As evident from the figure, the first two pairs of flux sources are left uncovered by superconducting sheets (14) in order that a clear picture of the present invention be provided. In actual electronic devices a series of perhaps ten or more pairs of eighth sphere sections is typically used, but for purposes of illustration a series of four is sufficient. However, it is to be understood that the principles of the present invention are in no way limited to any particular number of pairs utilized to make up a periodic permanent magnet structure and different numbers of pairs may be used in different applications.

The superconducting planar sheets 13 and 14 that are placed on the flat faces of the flux sources act as diamagnetic mirrors to the field abutting the sheet surface. Thus, the image of the cavity in the superconducting sheets appears to continue in both directions. Complete or full hollow spherical flux sources having uniform field strengths are thus magnetically created through the utilization of the superconducting sheets. Also, with the addition of the superconducting sheets there is no magnetic flux leakage since a magnetic field cannot penetrate a superconducting sheet. The superconducting sheets create an image as if there were a series of complete or full hollow spherical flux sources in pearl string fashion.

The superconducting face sheets 13 and 14 shown in the figure are typically quite thin. In practice, the essential requirement is that the sheet be thicker than the penetration depth of the specific superconducting material used. Materials such as tin, lead, niobium, tantulum among others are known to be superconducting below a distinct critical temperature. New ceramic materials have been recently developed in the field of superconductivity and are capable of achieving the superconducting state at critical temperatures above 77° K., the boiling point of liquid nitrogen. One such compound $RBa_2Cu_3O_{9-y}$ (where R stands for a transition metal or rare earth ion and y is a number less than 9, preferably $2.1\pm0.05$) has demonstrated superconductive properties above 90° K. Forming techniques include plasma spraying, sputtering, epitaxial film growing, etc. These materials and forming processes are merely exemplary and in no way limit the superconductivity material selected for the planar sheets and the manner thereof in which the material is formed.

As apparent from the figure, the magnetic field orientation in the central cavities 15 of alternate eighth sphere sections is reversed. The magnetic field orientation in each axial tunnel 16 is the opposite of that in the adjacent cavity and therefore a continually alternating magnetization along the particle beam path is fully realized.

The permeable plates 12 are much better heat conductors than the magnetic segments and these plates can extend beyond the periphery of the adjoininq sections. As a result, higher magnetic fields can be achieved, as well as better beam focusing, more efficient tube operation and longer tube life.

The magnetic material of the eighth sphere sections may be composed of $Nd_2Fe_{14}B$, Sm $Co_5$, $PtCo_5$, $Sm_2(CoT)_{17}$ where T is one of the transition metals, and so on. The foregoing materials are characterized by the fact that they maintain their full magnetization in fields larger than their coercivities. These and other equivalent magnetic materials (e.g., selected ferrites) are known to those in the art. Accordingly, it is to be understood that the principles of the present invention are in no way limited to the magnetic material selected for the segments. Also, as known to those skilled in the art, the segments can be pressed to the appropriate shape(s) and magnetized in the desired orientation using any of the known magnetization technique.

Having shown and described what is at present considered to be a preferred embodiment of the invention, it should be understood that the same has been shown by way of illustration and not limitation. And, all modifications, alterations and changes coming within the spirit and scope of the invention are meant to be included herein.

What is claimed is:

1. A periodic permanent magnet structure comprising a plurality of paired sections of hollow spherical flux sources having juxtaposed open ends, each flux source producing a uniform high-field in its central cavity, each pair of sections being mounted on opposite sides of a respective plate of permeable material so that the plate closes the open ends thereof, each flux source having an axial bore hole through the magnetic pole of the flux source, said bore hole continuing through each plate of permeable material, each set of paired sections being in tangential edge contact so that the magnetic field orientations are in alignment so as to form a continuous channel through the plurality of axially aligned flux sources, and a pair of superconducting planar sheets abutting the flat faces of each flux source.

2. A periodic permanent magnet structure as defined in claim 1 comprising eighth sphere sections, each having inner and outer radii equal to the respective radii of said hollow flux source.

3. A periodic permanent magnet structure as defined in claim 2 wherein the magnetic field orientations in each pair of sections are in opposite directions.

4. A periodic permanent magnet structure as defined in claim 3 wherein the magnetic field orientation in each axial bore hole of each section is the reverse of that in the adjacent cavity.

5. A periodic permanent magnet structure as defined in claim 4 wherein the plates of permeable material are at least peripherally coextensive with the sections mounted thereon.

* * * * *

UNITED STATES PATENT AND TRADEMARK OFFICE

CERTIFICATE OF CORRECTION

PATENT NO. : 4,887,058

DATED : Dec. 12, 1989

INVENTOR(S) : HERBERT A. LEUPOLD

It is certified that error appears in the above—identified patent and that said Letters Patent is hereby corrected as shown below:

Column 3, line 10, equation "$\alpha$ = 20" should read

-- $\alpha$ = 2θ--.

Signed and Sealed this

Twenty-third Day of October, 1990

*Attest:*

HARRY F. MANBECK, JR.

*Attesting Officer*

*Commissioner of Patents and Trademarks*